United States Patent [19]

Veazey

[11] Patent Number: 4,903,455

[45] Date of Patent: Feb. 27, 1990

[54] PANEL FOR A WINDOW WELL COVER AND THE LIKE

[76] Inventor: Robert M. Veazey, 6920 Woodbury, Wichita, Kans. 67226

[21] Appl. No.: 153,068

[22] Filed: Feb. 8, 1988

[51] Int. Cl.[4] ..... E04C 2/38

[52] U.S. Cl. ..... 52/822; 52/73; 52/823

[58] Field of Search ..... 52/73, 821, 822, 823, 52/824, 785, 786, 788, 790, 825, 826

[56] References Cited

U.S. PATENT DOCUMENTS

| | | | |
|---|---|---|---|
| 2,755,895 | 7/1956 | Walterman et al. | 52/826 |
| 2,793,688 | 5/1957 | Robey | 160/104 |
| 3,014,561 | 12/1961 | Ratner et al. | 52/823 |
| 3,024,880 | 3/1962 | Burmeister | 52/788 |
| 3,262,487 | 7/1966 | Gustafson et al. | 160/88 |
| 3,735,536 | 5/1973 | Bellasalma | 52/73 |
| 3,796,008 | 3/1974 | Eakin | 52/823 |
| 4,612,743 | 9/1986 | Salzer | 52/824 |
| 4,624,094 | 11/1986 | Schwindt | 52/822 |

FOREIGN PATENT DOCUMENTS

| | | | |
|---|---|---|---|
| 1226352 | 3/1971 | United Kingdom | 52/823 |
| 1406235 | 9/1975 | United Kingdom | 52/822 |

*Primary Examiner*—Michael Safavi
*Attorney, Agent, or Firm*—Bill D. McCarthy

[57] ABSTRACT

A panel enclosure comprising at least one panel which includes an extruded metal frame for receiving the perimeter portions of a sheet of plastic glazing in a loose fit to allow the plastic glazing to expand and contract therein, and a plurality of parallel cross bars received in opposite sides of the metal frame for supporting the plastic glazing at medial portions thereof.

8 Claims, 2 Drawing Sheets

PANEL FOR A WINDOW WELL COVER AND THE LIKE

BACKGROUND OF THE INVENTION

1. Field of the Invention

The present invention relates generally to building construction and more particularly, but by way of limitation, to a panel used as a window well cover, a lean-to for mounting against the side of a building and similar applications.

2. Brief Description of the Prior Art

Heretofore, there have been a great number of different types of frames used for windows and doors using glass or plastic glazing. Further, there have been a variety of different types of window well covers, skylights, frames for greenhouses, sunrooms and the like.

In Gustafson, et al., U.S. Pat. No. 3,262,487, a screen type window well cover is disclosed. The window well cover includes reinforcing bars should a person step thereon. The window well cover is hinged so the cover can be raised for access to the bottom of the window well.

Robey, U.S. Pat. No. 2,793,688, also discloses a window well cover formed of screen material and having rods underlying the cover to protect the well from falling objects.

None of the above-mentioned patents specifically disclose the unique frame structure and advantages of the subject panel for a window well cover and the like as described herein.

SUMMARY OF THE INVENTION

The present invention provides a panel for a window well cover and the like having an extruded metal frame with a cross section in an "E" shaped configuration. The frame is comprised of a plurality of joined together frame members, each such frame member having, in cross-sectional profile, an upwardly extending base, a lower arm extending outwardly from the bottom of the base, an intermediate arm extending outwardly from the base and an upper arm extending outwardly from the top of the base. A plastic glazing is received in an upper space between the intermediate arm and the upper arm and rides therein. An edge of the outer perimeter of the plastic glazing is disposed in a spaced relationship from the base of the frame member to allow for expansion and contraction of the plastic glazing. A plurality of cross bars are included in the panel with the ends of the cross bars received in opposite sides of the frame and in a lower space between the lower arm and the intermediate arm of the frame members and secured therein. The cross bars support a portion of the plastic glazing thereon protecting the panel and preventing bodily harm should the window well cover be stepped thereon.

An object of the subject invention is to provide a unique panel for weatherproofing structural openings, such as a window well, for such installation as a lean-to for mounting against the side of a building, and similar applications which can be quickly installed to provide protection from the inclement weather conditions.

Another object of the invention is to provide an extruded metal frame with a plastic glazing received therein in a loose fit which allows the plastic glazing to expand and contract with changes in temperature.

Other objects, advantages and features of the present invention will become clear from the following detailed description of the preferred embodiment when read in conjunction with the drawings and appended claims.

DETAILED DESCRIPTION OF THE DRAWINGS

Figure 1:
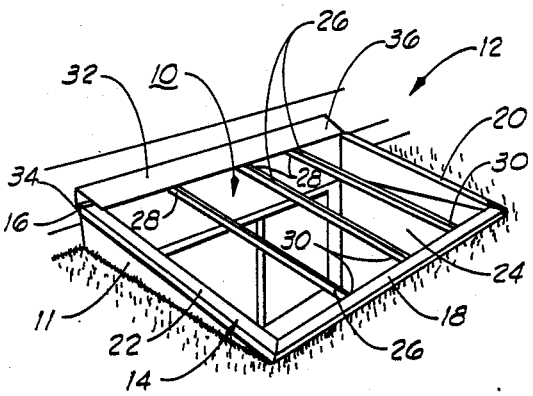
FIG. 1 is a perspective view of a panel constructed in accordance with the present invention and used as a window well cover.

In FIG. 1 a panel constructed in accordance with the present invention and used for a window well cover, a lean-to, or similar applications, is designated by the general reference number 10. In FIG. 1 the panel 10 is used as a window well cover for a window well 11 and attached to the side of a building 12. Broadly, the panel 10 includes a four-sided extruded metal frame 14 having an upper frame member 16, a lower frame member 18 and first and second side frame members 20 and 22. The frame members 16, 18, 20 and 22 are identical in construction (except for length) and are beveled at the ends and joined by a conventional manner, such as welding, to form the metal frame 14 as shown.

Figure 3:
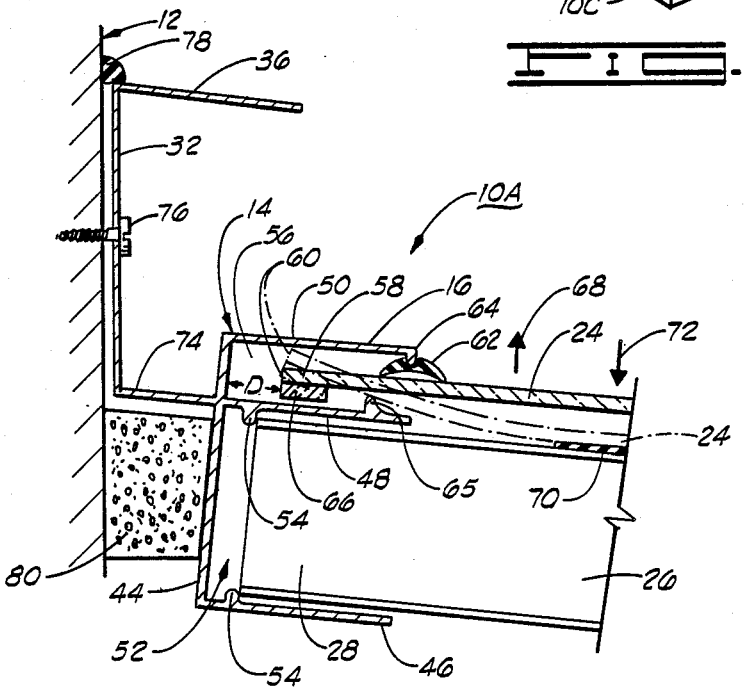
FIG. 3 is a side cross-sectional view of an upper frame member of the panel with a hinged inverted "L" shaped flashing attached to the side of the building shown in FIGS. 1 and 2.

The metal frame 14 receives the sides of a plastic glazing 24 therein and is shown in greater detail in the cross-sectional view of FIG. 3. The plastic glazing 24 is supported on the metal frame 14 by a plurality of cross bars 26 having opposite ends 28 and 30 received in the upper frame member 16 and lower frame member 18 respectively. The cross bars 26 are in a spaced parallel relationship to each other and to the first and second side frame members 20 and 22 with the spacing approximately two feet which provides adequate support for the plastic glazing 24. The glazing 24 is preferably an acrylic sheet having a thickness of about one eighth inch. The frame 14, the cross bars 26, together with the plastic glazing 24, provide sufficient strength to prevent a person from falling through the panel 10 and still provide sufficient protection from the outdoor weather.

An inverted "L" shaped flashing 32 is shown in FIG. 1 disposed along the length of the upper frame member 16 and secured thereto with a hinge 34. The flashing 32 is secured to the building 12 via conventional fasteners and serves to secure the panel 10 thereto. An outwardly extending flange 36 which is part of the flashing 32 acts to divert rain away from the side of the building 12 and onto the top of the panel 10. The panel 10 is preferably angled downwardly and away from the building 12, thereby insuring that the rain is diverted away from the window well 11.

Figure 2:
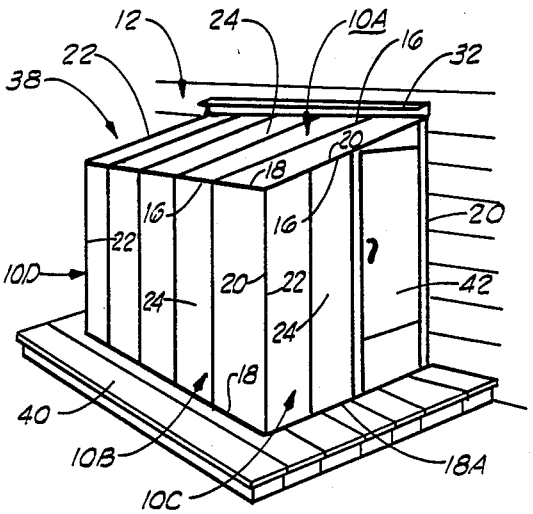
FIG. 2 is a perspective view of four panels of the present invention used in a multi-sided lean-to type enclosure mounted against the side of a building and on top of a wooden deck.

In FIG. 2 the panel 10 is used in a different application as a multi-sided lean-to 38. The lean-to 38 is attached to the side of the building 12 and mounted on top of a wooden deck 40. The multi-sided lean-to 38 uses four panels having the same construction and designated as a top panel 10A, a front panel 10B, a first side panel 10C, which can include a panel door 42 if desired, and a second side panel 10D. The second side panel 10D is hidden from view in FIG. 2, but is similar in shape to first side panel 10C.

The top panel 10A includes an inverted "L" shaped flashing 32 similar to flashing 32 shown in FIG. 1 for diverting rain from the side of the building 12. The four panels 10A, 10B, 10C and 10D are joined together and attached to the side of the building 12 and to the top of the wooden deck 40. The connection of the panels will be described in detail with reference to FIGS. 3 through 7.

FIG. 3 is a side cross-sectional view of a portion of one of the upper frame members 16 as shown. The upper frame member 16 is identical (in cross section) to part 16 of the panel 10 shown in FIG. 1. Also the inverted "L" shaped flashing 32 is identical in cross section to the flashing 32 of FIG. 1 (except hinge 34 is omitted). In this view the upper frame member 16, which is the same in cross section as the lower frame member 18 and first and second side frame members 20 and 22, includes an upwardly extending base 44; a lower arm 46 extending outwardly from the base 44; an intermediate arm 48 extending outwardly from the base 44; and an upper arm 50 extending outwardly from the top of the base 44. A space 52 between the lower arm 46 and intermediate arm 48 is dimensioned for receiving the end 28 of the cross bar 26. Stops 54 are extended from the lower arm 46 and from the intermediate arm 48 for engagement against the end 28 of the cross bar 26 while retaining a portion of the space therein for the heads of screw fasteners (not shown but similar to that shown in FIG. 4).

A space 56 is provided between the intermediate arm 48 and upper arm 50 for receiving an outer perimeter portion 58 of plastic glazing 24 therein in a loose fit leaving a distance "D" between the base 44 and an edge 60 of the perimeter portion 58 of the plastic glazing 24. The glazings are designated by the numeral 24 throughout the figures, although the sizes thereof will vary. In each case, the glazing 24 is a single sheet of very thin plastic secured and supported in the manner described herein. By providing the distance "D" in the upper frame member 16, as well as in the other frame members 18, 20 and 22, sufficient room is allowed for the plastic glazing 24 to expand and contract with temperature or load changes.

A cross section of a flexible gasket wiper wedge 62 is shown in FIG. 3 received around a portion of a rounded edge 64 of the end of the upper arm 50. The wiper wedge 62 extends along the length of the upper arm 50 for providing a watertight seal against the plastic glazing 24. Also the wiper wedge 62 prevents an air draft from circulating in and through the interior of the panel 10. Attached to the bottom of the perimeter portion 58 of the plastic glazing 24 is a retaining strip 66 which extends along the length of the perimeter portion 58 of the plastic glazing 24. Should the plastic glazing 24 bow outwardly as indicated by arrow 68, the retaining strip 66 moves downwardly and engages the top of the intermediate arm 48 to prevent the plastic glazing 24 from overextending. The bowing of the lightweight thin plastic glazing 24 is limited by the plastic retaining strip 66 and by an extension pivot 65 on the top of the intermediate arm 48. The pivot 65 extends along the length of the intermediate arm 48 and urges the plastic glazing 24 against the wiper wedge 62. As an added protection, a butyl adhesive tape 70 can be placed along the length and top of the cross bar 26 to engage and hold fast the plastic glazing 24 (depicted in phantom in FIG. 3) should it bow in the direction indicated by arrow 72. The flexibility of the adhesive tape 70 helps eliminate inward and outward movement of the plastic glazing 24 while permitting the plastic glazing 24 to continue to expand and contract along its length and width in the metal frame 14.

Extending outwardly from an opposite side of the base 44 is an intermediate arm extension 74 which can be used for attachment to the hinge 34 (in the embodiment of FIG. 1), or for securing the inverted "L" shaped flashing 32 to the upper frame member 16. A plurality of screw fasteners 76 can be used to attach the flashing 32 to the side of the building 12. Caulking 78 is preferably placed along the top of the flange 36 and against the side of the building 12. A foam sealant 80 is disposed below the extension 74 and against the side of the building 12 to prevent water leakage into the multi-sided lean-to 38 shown in FIG. 2 (or into the window well 11 in the embodiment of FIG. 1).

It should be noted that while the terms base 44, lower arm 46, intermediate arm 48, upper arm 50 and intermediate arm extension 74 are used herein with reference to the cross-sectional views of FIGS. 3 through 7, these elements of the extruded frame members 16, 18, 20 and 22, which make up the frame 14, are generally planar in construction and extend the full length of the frame members.

Figure 4:
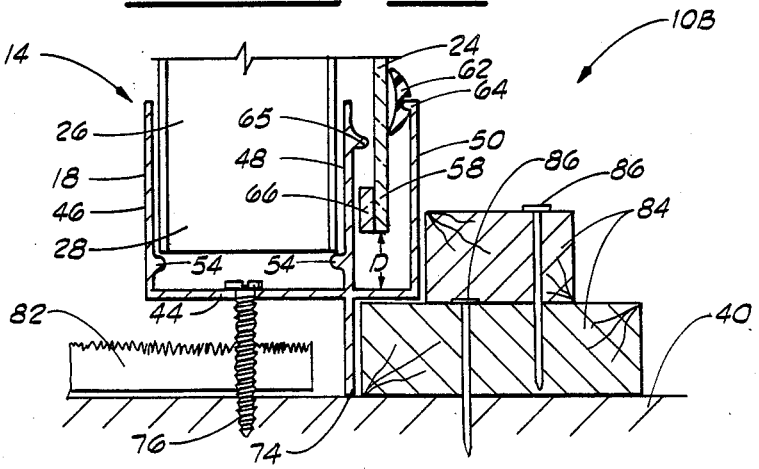
FIG. 4 is a side cross-sectional view of a lower frame member of the panel attached to the top of the outside wooden deck shown in FIG. 2.

FIG. 4 illustrates how the panel 10B is secured to the wooden deck 40 and on top of a portion of carpet 82. The attachment of the panels 10C and 10D to the deck 40 would be the same. In this figure the lower frame member 18, mentioned above and identical in cross section to the upper frame member 16 and first and second side frame members 20 and 22, is shown with the base 44 parallel to the wooden deck 40 with the end of the intermediate arm extension 74 resting on top thereof. The lower frame-member 18 is secured to the wooden deck 40 using a plurality of screw fasteners 76 through the base 44. It should be noted that the stops 54 prevent the end of the cross bar 26 from engaging the head of the screw fasteners 76 and ample room is provided for the heads of the fasteners 76 to be received therebetween. Also shown in this view is the perimeter portion 58 of the plastic glazing 24 received in the space 56 between the intermediate arm 48 and upper arm 50 with the wiper wedge 62 providing water and draft protection for the panel 10.

Shown adjacent the exterior side of the upper arm 50 and the intermediate arm extension 74 is a pair of trim boards 84 attached to the wooden deck 40 by nails 86 to provide added weather protection around the bottom of the lower frame member 18. Also the trim boards 84 are an attractive trim finish around the bottom of the multi-sided lean-to 38. While not shown in the drawings, the side frame members 20 and 22 of the first side panel 10C and second side panel 10D can be attached to the side of the building 12 in the same manner as the lower frame member 18 of the panel 10B is attached in FIG. 4. Also, other trim boards 84 can be nailed to the side of the building 12 and along the length of the side frame members 20 and 22.

Figure 5:
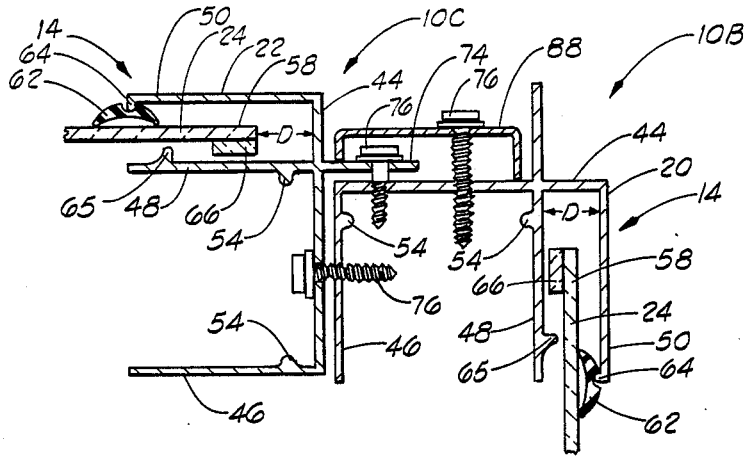
FIG. 5 illustrates a top cross-sectional view of side frame members of two panels of FIG. 2 joined together.

In FIG. 5 the second side member 22 of the first side panel 10C is shown attached to the first side member 20 of the front panel 10B. This is accomplished by using a plurality of screw fasteners 76 through the base 44 of the second frame member 22 and through the lower arm 46 of the first side member 20 of the front panel 10B. Also, plural screw fasteners 76 are used for attaching the intermediate arm extension 74 of the second side frame member 22 to a portion of the base 44 of the first side frame member 20. A trim strip 88 can be used to cover the connection of the intermediate arm extension 74 to the base 44. The trim strip 88 extends along the length of the base 44 of the first side frame member 20 and is secured thereto using screw fasteners 76. The connection of the two panels 10B and 10C illustrated in FIG. 5 can also be used on the opposite side of the front panel 10B for securing this panel to the side of the second side panel 10D in the manner described above.

Figure 6:
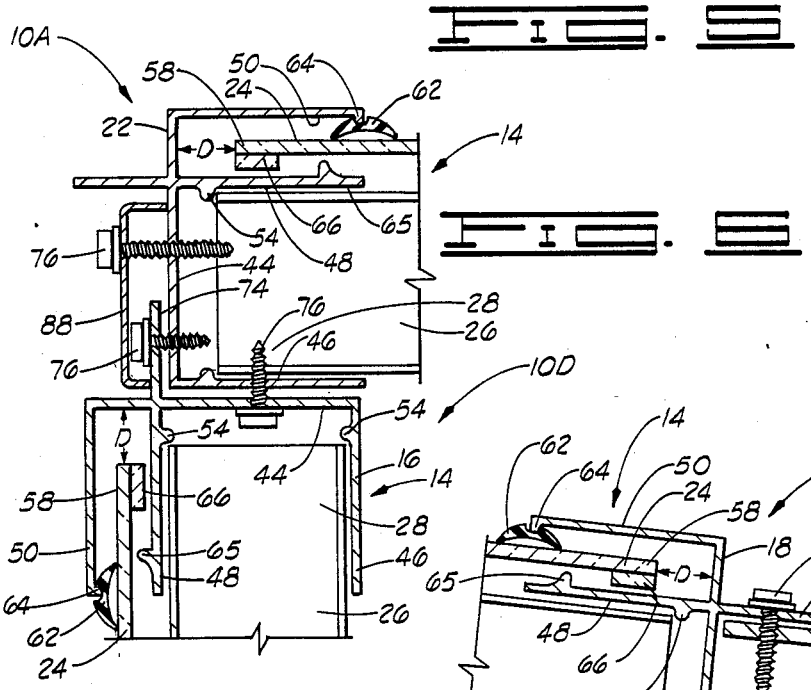
FIG. 6 illustrates a side cross-sectional view of a side frame member of the top panel of FIG. 2 attached to the upper frame member of a side panel.

In FIG. 6 one side of the top panel 10A is shown in cross section and attached to the top of the second side panel 10D. The other side of the top panel 10A is attached to the first side panel 10C in the same manner. Screw fasteners 76 are threaded through the base 44 of the upper member 16 of the second side panel 10D and through the lower arm 46 of the second side frame member 22 of the top panel 10A. Also, screw fasteners 76 can be threaded through the intermediate arm extension 74 of the upper frame 16 and through the base 44 of the second side frame member 22. This connection is covered with the trim strip 88 extending along the length of the base 44 of the second side frame member 22 and secured thereto using screw fasteners 76.

Figure 7:
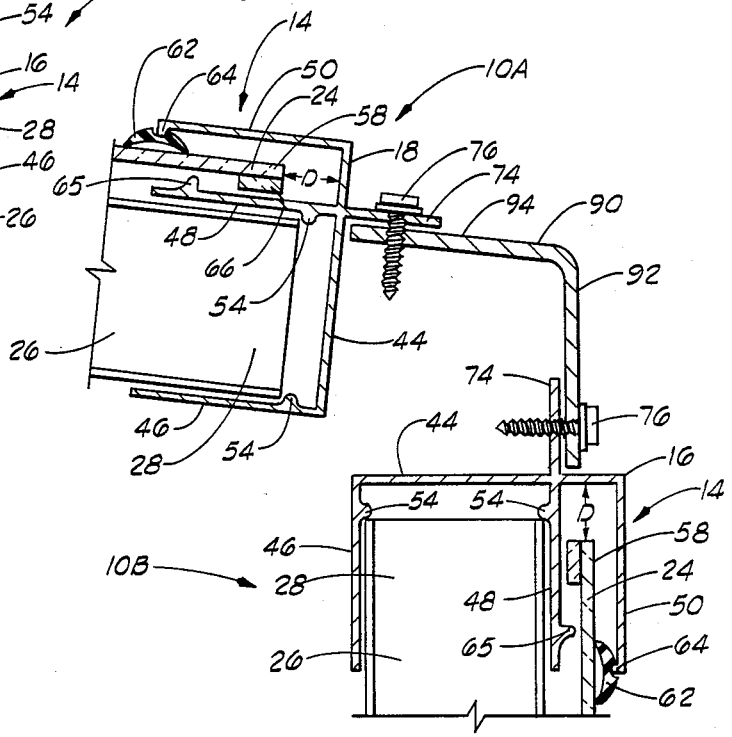
FIG. 7 is a side cross-sectional view of a lower frame member of a top panel attached to an upper frame member of a front panel as shown in FIG. 2.

In FIG. 7 the lower frame member 18 of the top panel 10A is shown attached to the top of the upper frame member 16 of the front panel 10B. Since the top panel 10A is sloped downwardly away from the building 12 to facilitate the runoff of rain or snow, the connection between the top panel 10A and the front panel 10B uses an angle trim strip 90 having a vertical arm 92 and a bent angle arm 94 which is bent to correspond with the slope of the top panel 10A. The end of the vertical arm 92 is attached to the side of the intermediate arm extension 74 of the upper frame member 16 of the front panel 10B using screw fasteners 76. The intermediate arm extension 74 of the lower frame member 18 of the top panel 10A is received on top of the angle arm 94 and secured thereto using screw fasteners 76.

From the above it will be appreciated that panel 10 used as a window well cover, and similar panels 10A, 10B, 10C, and 10D used for constructing a multi-sided enclosure 38, are readily adaptable for use in the construction of various types of greenhouses, sunrooms, skylights, and similar applications. The panel 10, with its metal frame 14, plastic glazing 24 and cross bars 26, provides a unique panel construction which allows for expansion and contraction of a unitary sheet of plastic glazing 24 while offering resistance to wind, rain, snow, and other weather conditions.

One feature of the panel 10 when used as the window well cover, as shown in FIG. 1, is the safety afforded by the hinge 34. An inside latch (not shown) is typically provided to secure the panel 10 in its down (or window sealing) position. Once unlatched, the panel 10 is easily rotated upwardly for emergency egress. Depending upon the depth of the window well, it may be desirable to provide a ladder or other stepping aid to facilitate personnel escape.

Also, it may be desirable to provide a lift assistance device, such as a spring or pneumatic cylinder (not shown), to bias the panel 10 to rotate in the upward direction when unlatched. For example, an inside latch having a string line release (for easy reach by children and persons of limited physical capability) can be provided which, once pulled, effects latch release and cylinder actuation for quick opening of the window well.

Another unique feature of the present invention, especially as it relates to the multi-sided enclosure 38, is that the enclosure is easily installed by a homeowner or tenant having minimal skill, and the enclosure 38 can also be disassembled, or broken down, for movement to a new installation site. Thus, a low-cost, easily transportable and readily installable enclosure unit is now available for homeowners, tenants and others.

It will be clear that the present invention is well adapted to carry out the objects and attain the advantages mentioned as well as those inherent therein. While a presently preferred embodiment of the invention has been described for purposes of this disclosure, numerous changes can be made which will readily suggest themselves to those skilled in the art and which are encompassed within the spirit of the invention disclosed and as defined in the appended claims.

What is claimed is:

1. A panel for a window well cover and the like, the panel comprising:

a frame comprised of a plurality of frame members, each frame member in cross section comprising:

a base having a top portion and a bottom portion;

a lower arm extending from the bottom portion of the base;

an intermediate arm extending from the base; and an upper arm extending from the top portion of the base;

a plastic glazing, an outer perimeter of the plastic glazing received in an upper space between the intermediate arm and the upper arm and riding therein, an edge of the outer perimeter of the plastic glazing disposed in a spaced relationship from the base to allow for expansion and contraction of the plastic glazing; and at least one cross bar, one end of the cross bar received in a lower space between the lower arm and the intermediate arm and secured therein, the cross bar supporting a portion of the plastic glazing thereon.

2. The panel of claim 1 wherein the intermediate arm of each frame member extends outwardly from one side of the base, each frame member further comprising an intermediate arm extension extending outwardly from an opposite side of the base.

3. A panel for a window well cover and the like, the panel comprising:

a four-sided frame comprising joined together extruded metal frame members, the frame members each comprising:

in cross section;

an upwardly extending base having a top portion and a bottom portion;

a lower arm extending outwardly from the bottom portion of the base;

an intermediate arm extending outwardly from the base; and an upper arm extending outwardly from the top portion of the base;

a plastic glazing, the outer perimeter portions thereof received in upper spaces between the intermediate arms and the upper arms of the frame members and riding therein, the edges of the plastic glazing disposed in spaced relationship from the bases of the frame members to allow for expansion and contraction of the plastic glazing; and at least one cross bar having the ends thereof received in opposite sides of the frame, the ends of the cross bar received in a lower space between the lower arms and the intermediate arms of the supporting frame members and secured therein, the cross bar supporting a portion of the plastic glazing thereon.

4. The panel of claim 3 wherein the bases have opposing sides, the intermediate arms extend outwardly from one side of the bases, and wherein the frame members further comprise intermediate arm extensions extending outwardly from the opposing sides of the bases.

5. A panel for a window well cover and the like, the panel comprising:

a frame comprised of a plurality of frame members, each frame member in cross section comprising:

a base having a top portion and a bottom portion;

a lower arm extending from the bottom portion of the base;

an intermediate arm extending from the base; and an upper arm extending from the top portion of the base, the upper arm having a rounded edge;

a plastic glazing having top and bottom surfaces, an outer perimeter of the plastic glazing received in an upper space between the intermediate arm and the upper arm and riding therein, an edge of the outer perimeter of the plastic glazing disposed in a spaced relationship from the base to allow for expansion and contraction of the plastic glazing;

at least one cross bar, one end of the cross bar received in a lower space between the lower arm and the intermediate arm and secured therein, the cross bar supporting a portion of the plastic glazing thereon; and a flexible gasket wiper wedge having a portion received on the rounded edge of the upper arm so that the wiper wedge is supported to engage a portion of the top surface of the plastic glazing.

6. The panel of claim 5 wherein each frame member further comprises an upwardly extending pivot disposed along the length of the intermediate arm for engaging a portion of the bottom surface of the plastic glazing.

7. The panel of claim 6 further comprising plastic retaining strips attached to the bottom surface of the plastic glazing so as to be disposed near the edges thereof.

8. The panel of claim 7 further comprising at least one adhesive tape strip disposed along the length of the cross bar and engaging a portion of the bottom surface of the plastic glazing to hold the plastic glazing thereagainst.

* * * * *